US010358393B2

(12) United States Patent
Rambow et al.

(10) Patent No.: US 10,358,393 B2
(45) Date of Patent: Jul. 23, 2019

(54) GAS GENERATING COMPOSITIONS AND METHODS OF MAKING AND USING THEREOF

(71) Applicant: Joyson Safety Systems Acquisition LLC, Auburn Hills, MI (US)

(72) Inventors: Scott Rambow, Roseville, MI (US); Deborah Hordos, Troy, MI (US); Sudhakar Ganta, Troy, MI (US)

(73) Assignee: Joyson Safety Systems Acquisition LLC, Auburn Hills, MI (US)

( * ) Notice: Subject to any disclaimer, the term of this patent is extended or adjusted under 35 U.S.C. 154(b) by 0 days.

(21) Appl. No.: 15/601,224

(22) Filed: May 22, 2017

(65) Prior Publication Data

US 2017/0334802 A1 Nov. 23, 2017

Related U.S. Application Data

(63) Continuation of application No. 62/340,177, filed on May 23, 2016.

(51) Int. Cl.

| | |
|---|---|
| ***C06B 31/12*** | (2006.01) |
| ***C06B 31/02*** | (2006.01) |
| ***C06B 23/00*** | (2006.01) |
| ***C06B 25/00*** | (2006.01) |
| ***C06B 31/28*** | (2006.01) |
| ***C06B 33/06*** | (2006.01) |
| ***C06D 5/06*** | (2006.01) |
| *C06B 31/00* | (2006.01) |
| *D03D 23/00* | (2006.01) |
| *D03D 43/00* | (2006.01) |

(52) U.S. Cl.

CPC ..... *C06B 31/02* (2013.01); *C06B 23/001* (2013.01); *C06B 25/00* (2013.01); *C06B 31/28* (2013.01); *C06B 33/06* (2013.01); *C06D 5/06* (2013.01)

(58) Field of Classification Search

USPC ..... 149/2, 45, 61, 62, 109.2, 109.4

See application file for complete search history.

(56) References Cited

U.S. PATENT DOCUMENTS

| | | | | |
|---|---|---|---|---|
| 5,566,543 | A * | 10/1996 | Taylor | C06B 45/10 149/19.91 |
| 6,004,411 | A | 12/1999 | Zeuner et al. | |
| 6,143,102 | A | 11/2000 | Mendenhall et al. | |
| 6,416,599 | B1 | 7/2002 | Yoshikawa et al. | |
| 6,505,562 | B1 | 1/2003 | Wu | |
| 6,517,647 | B1 | 2/2003 | Yamato | |

(Continued)

FOREIGN PATENT DOCUMENTS

| | | |
|---|---|---|
| EP | 1069096 A1 | 1/2001 |
| EP | 1205457 A1 | 5/2002 |
| JP | 4703837 | 6/2011 |

OTHER PUBLICATIONS

International Search Report and Written Opinion issued in International Application No. PCT/US2017/033777, dated Aug. 24, 2017.

(Continued)

*Primary Examiner* — James E McDonough

(74) *Attorney, Agent, or Firm* — Meunier Carlin & Curfman LLC

(57) ABSTRACT

Disclosed are gas generating compositions and methods of making and used them.

19 Claims, 4 Drawing Sheets

(56) References Cited

U.S. PATENT DOCUMENTS

| | | | | |
|---|---|---|---|---|
| 8,206,522 | B2 * | 6/2012 | Sandstrom | C06B 33/08 149/108.2 |
| 8,216,402 | B2 | 7/2012 | Gaudre et al. | |
| 8,231,747 | B2 | 7/2012 | Mendenhall et al. | |
| 8,282,749 | B1 | 10/2012 | Sabatini et al. | |
| 2003/0024618 | A1 | 2/2003 | Wu et al. | |
| 2003/0051630 | A1 | 3/2003 | Katsuda et al. | |
| 2004/0069383 | A1 | 4/2004 | Sato | |
| 2004/0173922 | A1 | 9/2004 | Barnes et al. | |
| 2004/0226639 | A1 | 11/2004 | Redecker et al. | |
| 2004/0256038 | A1 | 12/2004 | Wood | |
| 2005/0263224 | A1 * | 12/2005 | Wu | C06D 5/06 149/46 |
| 2005/0274440 | A1 | 12/2005 | Tomiyama | |
| 2007/0102076 | A1 | 5/2007 | Redecker et al. | |
| 2007/0119530 | A1 | 5/2007 | Zhou et al. | |
| 2008/0105342 | A1 | 5/2008 | Wu | |
| 2009/0255611 | A1 | 10/2009 | Lund et al. | |
| 2009/0308509 | A1 * | 12/2009 | Marlin | C06B 21/0041 149/45 |
| 2010/0051149 | A1 | 3/2010 | Blanchard et al. | |
| 2010/0078098 | A1 | 4/2010 | Wu et al. | |
| 2012/0000583 | A1 | 1/2012 | Ogata et al. | |
| 2012/0055593 | A1 * | 3/2012 | Kobayashi | C06D 5/06 149/19.1 |
| 2012/0160379 | A1 | 6/2012 | Marlin et al. | |
| 2013/0319586 | A1 | 5/2013 | Kobayashi | |
| 2013/0248062 | A1 | 9/2013 | Friedrich et al. | |
| 2013/0340900 | A1 | 12/2013 | Kobayashi | |
| 2014/0116584 | A1 | 5/2014 | Marlin et al. | |
| 2014/0261927 | A1 | 9/2014 | Mendenhall et al. | |

OTHER PUBLICATIONS

Jet milling. Product description [online] Hovione capabilities, 2014, p. 1, [retrieved on Jul. 28, 2017] Retrieved from the internet web archive (Dec. 1, 2014) URL:https://web.archive.org/web/20141201022823/http://www.hovione.com/products-and-services/contract-manufacturing-services/particle-engineering/technologies/jet-milling>.

* cited by examiner

GAS GENERATING COMPOSITIONS AND METHODS OF MAKING AND USING THEREOF

CROSS REFERENCE TO RELATED APPLICATIONS

This application claims the benefit of priority to U.S. Provisional Application 62/340,177, filed May 23, 2016, which is incorporated by reference herein in its entirety.

FIELD

The present disclosure relates to gas generating compositions suitable for an air bag system, molded articles from such compositions, and methods of making and using such compositions and articles.

BACKGROUND

Airbag systems have been widely adopted in recent years for improving the safety of riders in automobiles. In these systems, a gas generator is operated by signals from a sensor detecting a collision and inflates an airbag between a rider and the body of the automobile. The gas generator is required to produce a sufficient amount of gas to inflate the airbag in a very short time.

The compositions used to generate gas in current gas generators contain an oxidizer and a fuel. The particular components used in a given composition, and the amount of these components, greatly affects the properties (e.g., ignition rate, burn rate, etc.) and thus the suitability of a composition for inflating an airbag.

Gas generating compositions containing basic copper nitrate as the oxidizer and high amounts of guanidine nitrate as the fuel have been used for gas generation. In these compositions metal oxides and hydroxides are also used to improve combustion. Melamine is sometimes used as a secondary fuel and is thus present in smaller amounts than the primary fuel. While these materials are useful in many situations, improved compositions are still needed.

As an example, it is desirable to have a gas generating composition that has consistent performance over a wide range of pressures. Also, gas generating compositions that work well at lower pressures are also beneficial. The ability to work well at lower pressures can permit the composition to be used with lighter inflator structures, e.g., different inflator materials like aluminum or plastic may be used. Also, the inflator systems can omit booster chambers and filters if a lower pressure gas generating composition is used. Another likely advantage is that no separate auto-ignition material may be needed and there is a potential for direct ignition. Given these and other advantages, there is a need for new gas generating compositions with consistent performance over a wide range of pressures, and good performance a lower pressures. The compositions and methods disclosed herein address these and other needs.

SUMMARY

In accordance with the purposes of the disclosed materials, compounds, compositions, articles, and methods, as embodied and broadly described herein, the disclosed subject matter relates to compositions, methods of making said compositions, and methods of using said compositions. More specifically, disclosed herein are gas generating compositions and methods of making such compositions. Also disclosed are molded articles comprising the gas generating compositions described herein as well as methods of making the articles. Further, disclosed herein are gas generators and inflator systems comprising the compositions and molded articles described herein.

In a specific aspect, disclosed herein are gas generating compositions that contain one or more oxidizers and one or more fuels. In yet a more specific aspect, disclosed herein are gas generating compositions that contain from 45 to 55% by weight of a metal nitrate as an oxidizer; from 25 to 30% by weight of melamine nitrate as a primary fuel. The compositions disclosed herein can optionally contain from 5 to 15% by weight of a nitrogen containing organic compound as a secondary fuel. These compositions can optionally contain from 1 to 10% by weight of one or more additional oxidizers. Stabilizers, binders and other additives can also be present in the disclosed gas generating compositions. Also disclosed are compositions that comprise from 25 to 30% by weight of melamine nitrate; wherein the composition has a pressure exponent of less than 0.5 when combusted in a combustion chamber over a pressure range of from 1 to 20 MPa.

Additional advantages will be set forth in part in the description that follows or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE FIGURES

The accompanying figures, which are incorporated in and constitute a part of this specification, illustrate several aspects described below.

DETAILED DESCRIPTION

Figure 1:
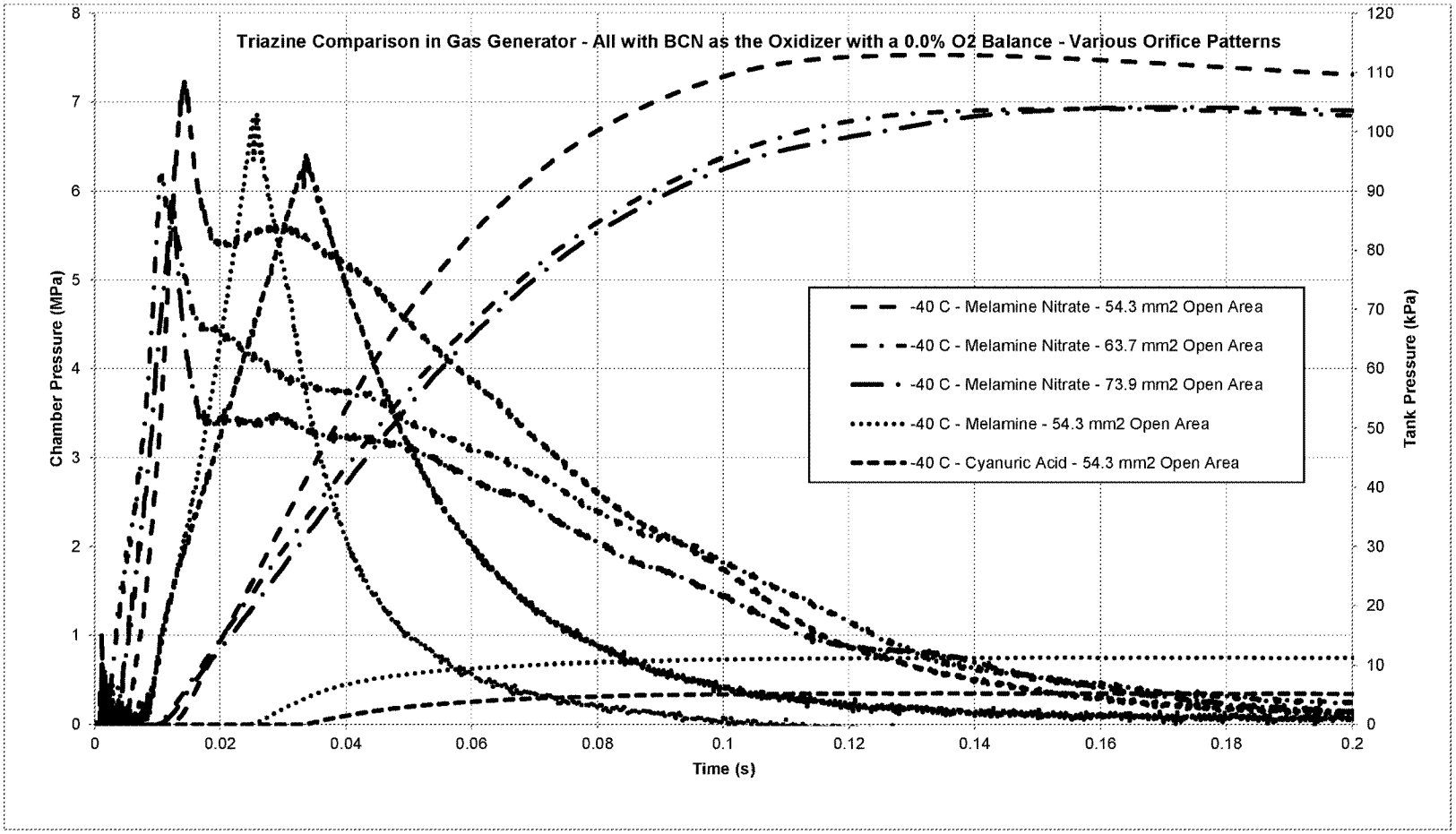
FIG. 1 is a graph of the gas generator performance of several gas generating compositions, wherein internal gas generator combustion pressure (in MPa) is represented on the primary y axis, and ballistic tank pressure (in kPa) is represented on the secondary y axis.

The materials, compounds, compositions, articles, and methods described herein may be understood more readily by reference to the following detailed description of specific aspects of the disclosed subject matter and the Examples included therein.

Before the present materials, compounds, compositions, articles, and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "the compound" includes mixtures of two or more such compounds, and the like.

"Optional" or "optionally" means that the subsequently described event or circumstance can or cannot occur, and that the description includes instances where the event or circumstance occurs and instances where it does not.

Reference will now be made in detail to specific aspects of the disclosed materials, compounds, compositions, articles, and methods, examples of which are illustrated in the accompanying Examples and Figures.

The examples below are intended to further illustrate certain aspects of the methods and compounds described herein, and are not intended to limit the scope of the claims.

Gas Generating Compositions

Disclosed herein are gas generating compositions, also termed "propellants," that contain one or more oxidizers and one or more fuels. In certain examples, the disclosed compositions contain a metal nitrate as the oxidizer with melamine nitrate as the primary fuel. This combination has been found to permit low pressure combustion in an inflator, also known as a gas generator, while producing clean burning effluents. This improves the versatility when designing inflators, allowing for the use of lower strength and lighter steels, leading to decreased weight and cost. The introduction of a secondary fuel can improve auto-ignition performance also allowing more versatility when designing inflators and complimentary booster and auto-ignition compositions. The disclosed compositions can also contain a secondary oxidizer, which can limit the formation of undesirable effluent gases such as CO, $NO_x$, and $NH_3$ compared to similar formulations without said secondary oxidizer. Also, as disclosed herein, various additives can be present in the disclosed compositions.

Disclosed herein are gas generating compositions that comprise one or more oxidizers, one or more fuels, and optional additives.

Oxidizers

In specific examples of the disclosed compositions, the oxidizer is a metal nitrate. In further specific examples, the metal nitrate is a basic metal nitrate. A suitable basic metal nitrate can be chosen from a basic copper nitrate, a basic cobalt nitrate, a basic zinc nitrate, a basic manganese nitrate, a basic iron nitrate, a basic molybdenum nitrate, a basic bismuth nitrate, and a basic cerium nitrate. Specific examples of suitable metal nitrates are $Cu_2(NO_3)(OH)_3$, $Cu_3(NO_3)(OH)_5$ $2H_2O$, $Co_2(NO_3)(OH)_3$, $Zn_2(NO_3)(OH)_3$, $Mn(NO_3)(OH)_2$, $Fe_4(NO_3)(OH)_{11}.2H_2O$, $MoO_2(NO_3)_2$, $Bi(NO_3)(OH)_2$ and $Ce(NO_3)_3(OH).3H_2O$. Among these, a basic copper nitrate is preferable.

The metal nitrate component can be present in the disclosed compositions at an amount of from 45 to 55% by weight. For example, the metal nitrate can be present at 45, 46, 47, 48, 49, 50, 51, 52, 53, 54, or 55% by weight, where any of the stated values can be an upper or lower end point of a range. In a particular example, the metal nitrate can be present at from 48 to 53%, from 49 to 52%, from 50 to 53%, from 50 to 52%, or from 51 to 52% by weight. In a specific example, the metal nitrate can be present in the composition at 51.5% by weight.

In addition to the metal nitrate, the disclosed compositions can also contain one or more secondary oxidizers. The secondary oxidizers can be chosen from alkali metal and alkaline earth metal salts of perchloric acid. Specific examples of these secondary oxidizers that are suitable for use herein include ammonium perchlorate, sodium perchlorate, potassium perchlorate, magnesium perchlorate and barium perchlorate. In a specific example, the secondary oxidizer is potassium perchlorate. Further examples of secondary oxidizers can include carbonates such as ammonium carbonate, calcium carbonate, basic copper carbonate, basic bismuth carbonate, magnesium carbonate, and combinations thereof. In a specific example, the secondary oxidizer basic copper carbonate can be used.

The secondary oxidizer component can be present in the disclosed compositions at an amount of from 1 to 10% by weight. For example, any one of the secondary oxidizers disclosed herein can be present at 1, 2, 3, 4, 5, 5, 7, 8, 9, or 10% by weight, where any of the stated values can be an upper or lower end point of a range. In further examples, any one of the secondary oxidizers can be present at from 4 to 8%, from 5 to 7%, from 6 to 9%, from 1 to 4%, or from 3 to 5% by weight of the composition. In specific examples, the secondary oxidizer component can comprise basic copper carbonate at 6% and potassium perchlorate at 3% by weight of the composition.

Fuels

In the disclosed compositions, the primary fuel is melamine nitrate. The melamine nitrate can be present in the composition at from 25 to 30% by weight. For example, the melamine nitrate can be present in the disclosed composition in an amount of 25, 26, 27, 28, 29, or 30% by weight, where any of the stated values can be an upper or lower endpoint of a range. In particular examples, the melamine nitrate can be present at from 26 to 29% or from 27 to 28% by weight. It has been found that the use of melamine nitrate as the primary fuel can permit low pressure (especially at low temperature) combustion.

The secondary fuel can be a nitrogen containing organic compound. The use of a secondary fuel can improve auto-ignition performance (lower temperature). In specific examples, the nitrogen containing organic compound can be guanidine or a guanidine derivative. The guanidine derivative can be chosen from nitroguanidine, guanidine nitrate, aminoguanidine, aminoguanidine nitrate, and aminoguanidine hydrogen carbonate. In a preferred example, the nitrogen containing compound is guanidine nitrate.

In other examples, the nitrogen containing organic compound can be chosen from tetrazole or a tetrazole derivative chosen from aminotetrazole, bitetrazole, azobitetrazole, nitrotetrazole, and nitroaminotetrazole.

The secondary fuel can be present in the disclosed compositions at an amount of from 5 to 15% by weight. For example, the secondary fuel can be present at 5, 6, 7, 8, 9 10, 11, 12, 13, 14, or 15% by weight, where any of the stated values can be an upper or lower end point of a range. In particular examples, the secondary fuel can be present at from 5 to 10%, from 7 to 12%, from 9 to 14%, from 6 to 13%, from 8 to 11%, from 9 to 10%, from 10 to 11%, or 10% by weight.

It can be desired that certain, or all, of the components of the disclosed composition can be provided in small particles sizes, e.g., 20 μm or less. For example, melamine nitrate can be used that is less than 20 μm. Obtaining small particle sizes can be achieved by milling, e.g., with vibratory or jet mills. The particular size that is used can depend on the particular compound, application, and formulation. In certain examples, the primary fuel is jet milled to a size of from 1 to 20 μm, more specifically less than 10 μm.

Additives

The disclosed compositions can also optionally contain additional additives. For examples, additives to permit cooler gas temperature, slagging, improve effluents, improve binding, and improve powder flow can be added.

Additives for lubrication can also optionally be added. Lubricants can permit improved powder flow during processing and pressing and improve slagging. For example, the disclosed compositions can contain from 0.1 to 0.5% by weight of polyethylene, e.g., 0.1, 0.2, 0.3, 0.4, or 0.5% by weight, where any of the stated values can form an upper or lower endpoint of a range. In a specific example, polyethylene can be present at 0.2% by weight of the composition.

In another example, the disclosed compositions can contain from 1 to 3% by weight of fumed silica, fumed alumina, aluminum hydroxide, aluminum titanate, magnesium aluminate, or any combination thereof. In a specific example, the disclosed compositions can contain from 1 to 3% magnesium aluminate.

The disclosed compositions can further contain an optional binder for increasing the strength of a molded article made from the composition. Suitable binders can be chosen from carboxymethylcellulose, sodium carboxymethylcellulose, potassium carboxymethylcellulose, ammonium carboxymethylcellulose, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, fine crystalline cellulose, polyacrylic amide, amine products of polyacrylic amide, polyacrylic hydrazide, a copolymer of an acrylic amide and a metal salt of acrylic acid, a copolymer of polyacrylic amide and polyacrylic ester compound, polyvinyl alcohol, acrylic rubber, guar gum, starch and silicone is proposed. If present, the binder can be present in the disclosed compositions in an amount of from 0.1 to 10% by weight.

The disclosed compositions can also contain processing aids and burn moderators at a proportion of up to 5% by weight related to the total composition. Suitable processing aids can be chosen from the anti-caking agents, pressing aids, anti-blocking agents. Examples of processing aids and burn moderators are polyethylene glycol, soot, graphite, wax, calcium stearate, magnesium stearate, zinc stearate, boron nitride, talcum, bentonite, alumina, silica and molybdenum disulfide. These agents have an effect even in minimum quantities and affect the properties and combustion behavior either not at all or only to a minor extent.

The disclosed gas generating compositions can effectively generate gas at a wide range of pressures and at low pressures. For examples, when the burn rate of the gas generating composition is determined over a pressure range of from 1 to 20 MPa, the pressure exponent can be less than 0.5. Burn rate is equal to $\alpha p^n$, where "α" is a variable that represents the initial grain temperature, and "p" is the pressure in the combustion chamber. The value "n" is the pressure exponent and should be close to 0 over the range of pressures in the combustion chamber. In a specific example, the disclosed compositions can comprise from 25 to 30% by weight of melamine nitrate; wherein the composition has a pressure exponent of less than 0.5 when combusted in a combustion chamber over a pressure range of from 1 to 20 MPa.

Articles

The disclosed gas generating compositions can be prepared by mixing the various components disclosed herein in the described amounts. For example, the components can be ground separately or together in a pin mill, vibratory mill, or jet mill. Particle sizes of the components can range from 1 to 20 μm (e.g., 1, 5, 10, 15, or 20 μm, where any of the stated values can form an upper or lower endpoint of a range); the particular size can be varied depending on the desired performance. The milled powders can be blended in a ribbon blender. The blended powder can be compacted and granulated on a roll compactor (e.g. at pressures of from $10^2$ to $10^3$ MPa) and subsequent in-line granulator, and the granules compressed on a traditional tablet press.

In a specific example, disclosed is a method of forming a molded article by dry blending the one or more fuels and one or more oxidizers and optional additives, as described herein. This can be accomplished by a plough type blender (e.g., a fluidizing paddle blender). The blend can be roll compacted and granulated (e.g., with a roll compactor with in-line granulator). A target sieve cut of the granules can be collected. The remaining material can be recycled into the roll compacting step. A lubricant can be finally added to the granules in a tumbling blender and mixed. The mixture can be pressed on a tablet press.

In one specific aspect, the disclosed gas generating compositions can be prepared by mixing the metal nitrate, melamine nitrate, and secondary fuel in any order. The secondary oxidizer can also be combined with these components in any order. The resulting composition can then be granulated. At this point, before pressing, optional binders and lubricants can also be added. Such binders and lubricants can also be added before granulation, or even added before and after granulation, or both.

Thus disclosed herein, in certain aspects, is a method of forming a molded article by combining from 45 to 55% by weight of a metal nitrate; from 25 to 30% by weight of melamine nitrate; from 5 to 15% by weight of a nitrogen containing organic compound, and optionally from 1 to 10% by weight of one or more secondary oxidizers chosen from an alkali metal or alkaline earth metal salts of perchloric acid and carbonates (e.g., basic copper carbonate or basic bismuth carbonate) to form a blend. The blend can then be stored and later formed into an article at a later time. Alternatively, the blend can be granulated and then stored so that it can be pressed into a molded article at a later time. Still further the blend can be granulated and then pressed into a molded article. Polyethylene, fumed silica, fumed alumina, aluminum hydroxide, aluminum titanate, magnesium aluminate, and/or other additives can be added to the blend before granulating the blend. Lubricants (e.g., polyethylene, polyethylene glycol or calcium stearate) can be added after granulation.

In a specific example, the disclosed articles can be prepared by combining from 45 to 55% by weight of basic copper nitrate; from 25 to 30% by weight of melamine nitrate; from 5 to 15% by weight of guanidine nitrate; and from 2 to 4% by weight of potassium perchlorate, from 5 to 7% of basic copper carbonate, from 1 to 3% of fumed alumina, aluminum hydroxide, aluminum titanate, magnesium aluminate, or combinations thereof, and from 0.1 to 0.4% of polyethylene to form the blend; granulating the blend, and then pressing the blend into the molded article.

The pressed, molded articles of the gas generating compositions disclosed herein can be in a desired shape, for example in the form of a cylinder, a single-perforated cylinder, a perforated cylinder, a doughnut or a pellet. The molded article can also be produced by adding water or an organic solvent to the gas generating compositions, then mixing them, and extrusion-molding the mixture (molded product in the form of a single-perforated cylinder or a perforated cylinder) or compression-molding the mixture (molded product in the form of a pellet) by a tableting machine.

The adjustment of the rate of combustion can be achieved through the shape and size of the grains of the bulk material obtained by breaking and sieving out the fragments. The bulk material can be produced in large quantities and adapted to meet particular combustion requirements by mixing fractions with different dynamic liveliness. To improve the results of mixing, premixtures of 2 or 3 components can also be used. A mixture of oxidant and additions may, for example, be made before it comes into contact with the nitrogen-containing compounds.

Method of Use

The disclosed compositions can be used in powdered form or in molded form. The molded articles can be introduced in loose bulk or in oriented fashion into appropriate pressure-proof containers. They are ignited according to conventional methods with the aid of initiator charges or thermal charges wherein the thus-formed gases, optionally after flowing through a suitable filter, lead to inflation of the airbag system within fractions of a second. The compositions disclosed herein are especially suited for so-called airbags, impact bags which are utilized in automotive vehicles for occupants' protection. In case of vehicle impact, the airbag must fill up within a minimum time period with gas quantities of about 20 to 200 liters, depending on system and automobile size. The disclosed compositions are likewise suitable for use in seat belt-tightening devices, for example retractors or pretensioners.

Further, disclosed are inflators comprising the disclosed gas generating compositions. The disclosed inflators can be aluminum or plastic. Because the disclosed compositions are effective at low pressures, the inflators can omit booster chambers and filters.

EXAMPLES

The following examples are set forth below to illustrate the methods, compositions, and results according to the disclosed subject matter. These examples are not intended to be inclusive of all aspects of the subject matter disclosed herein, but rather to illustrate representative methods, compositions, and results. These examples are not intended to exclude equivalents and variations of the present invention, which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of reaction conditions, e.g., component concentrations, temperatures, pressures, and other reaction ranges and conditions that can be used to optimize the product purity and yield obtained from the described process. Only reasonable and routine experimentation will be required to optimize such process conditions.

Example 1: Composition Preparation

A composition was prepared with the components detailed in Table 1. The powders were combined and blended in a vibratory mill. The blended powder was compacted and granulated. The granules were then compressed on a tablet press. The polyethylene was added 0.1% before granulation and 0.1% after granulation.

TABLE 1

| Component Name | Wt. % | Mass (g) |
|---|---|---|
| Basic Copper Nitrate | 51.5% | 515 |
| Melamine Nitrate | 27.3% | 273 |
| Guanidine Nitrate | 10.0% | 100 |
| Basic copper carbonate | 6.0% | 60 |
| Potassium perchlorate | 3.0% | 30 |
| Fumed Alumina | 2.0% | 20 |
| Polyethylene | 0.2% | 2 |
| TOTALS: | 100.00 | 1000 |

Figure 2:
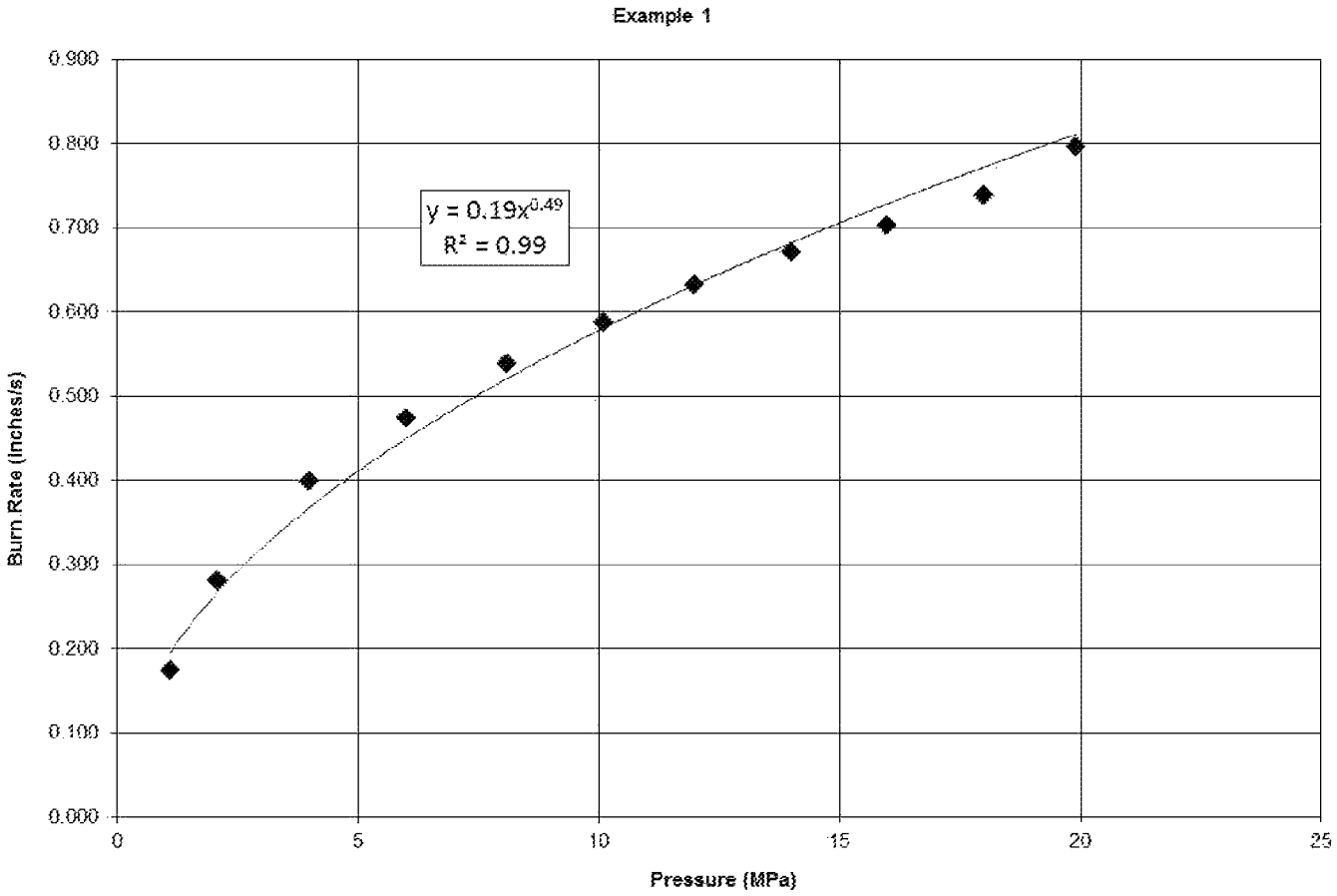
FIG. 2 is a graph of the burn rate (in inches per second) at various pressures of the generating compositions of Example 1.

The composition was then tested for burn rate at various pressures. The results are shown in FIG. 2. Burn rate is expressed as $r=\alpha p^n$, where r is the burn rate, "$\alpha$" is a variable that represents the initial grain temperature, and "p" is the pressure in the combustion chamber. The value "n" is the pressure exponent and should be close to 0 over the range of pressures. Here n is 0.49, with a 0.99 $R^2$ value over pressures ranging from 1 to 20 MPa. This indicates that the composition is not significantly influenced by low pressure environments. Stated another way, the low pressure exponent burn rate curve suggests minimal burn rate dependence on pressure, allowing low pressure combustion and all the benefits disclosed herein.

Example 2: Composition Preparation

A composition was prepared with the components detailed in Table 2. The powders were combined and blended in a vibratory mill. The blended powder was compacted and granulated. The granules were then compressed on a tablet press. The polyethylene was added 0.1% before granulation and 0.1% after granulation.

TABLE 2

| Component Name | Wt. % | Mass (g) |
|---|---|---|
| Basic Copper Nitrate | 51.5% | 515 |
| Melamine Nitrate | 27.3% | 273 |
| Guanidine Nitrate | 10.0% | 100 |
| Basic copper carbonate | 6.0% | 60 |
| Potassium perchlorate | 3.0% | 30 |
| Magnesium aluminate | 2.0% | 20 |
| Polyethylene | 0.2% | 2 |
| TOTALS: | 100.00 | 1000 |

Figure 3:
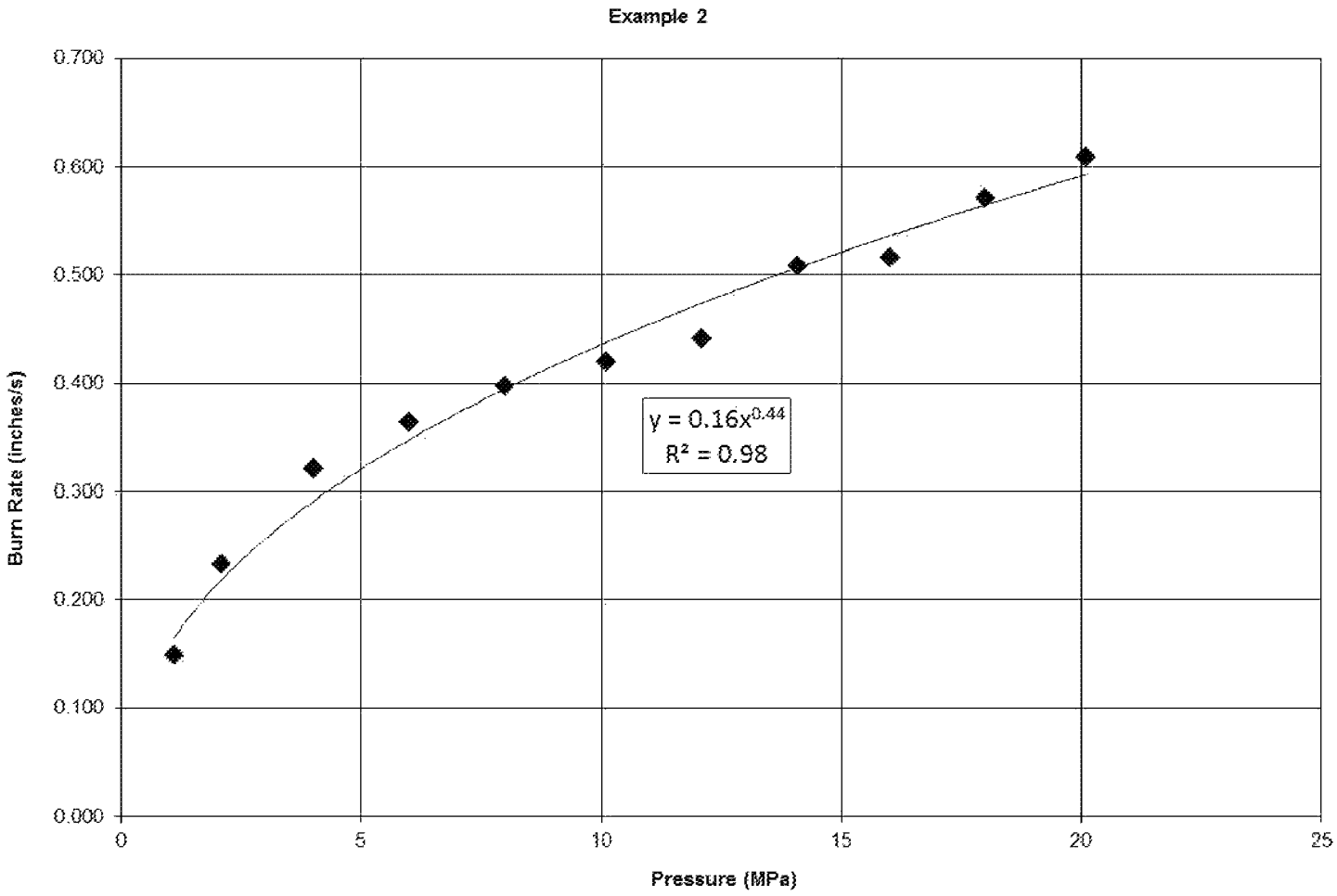
FIG. 3 is a graph of the burn rate (in inches per second) at various pressures of the generating compositions of Example 2.

The composition was then tested for burn rate at various pressures. The results are shown in FIG. 3. Again, n is 0.44, with a 0.98 $R^2$ value over pressures ranging from 1 to 20 MPa. The data show that compositions as disclosed herein have a consistent slope, and thus a consistent burn rate even at lower pressures.

Example 3: Composition Preparation (Comparative)

A composition was prepared with the components detailed in Table 3. The powders were combined and blended in a vibratory mill. The blended powder was compacted and granulated. The granules were then compressed on a tablet press. The polyethylene was added 0.1% before granulation and 0.1% after granulation.

TABLE 3

| Component Name | Wt. % | Mass (g) |
|---|---|---|
| Basic Copper Nitrate | 65.71 | 657.11 |
| Cyanuric acid | 34.09 | 340.89 |
| Polyethylene | 0.20 | 2.00 |
| TOTALS: | 100.00 | 1000.00 |

The burn rate of the composition was tested but the composition would not ignite, even at higher pressures.

Example 4: Composition Preparation (Comparative)

A composition was prepared with the components detailed in Table 4. The powders were combined and blended in a vibratory mill. The blended powder was compacted and granulated. The granules were then compressed on a tablet press. The polyethylene was added 0.1% before granulation and 0.1% after granulation.

TABLE 4

| Component Name | Wt. % | Mass (g) |
|---|---|---|
| Basic Copper Nitrate | 79.52 | 795.19 |
| Melamine | 20.28 | 202.81 |
| Polyethylene | 0.20 | 2.00 |
| TOTALS: | 100.00 | 1000.00 |

The burn rate of the composition was tested but the composition would not ignite, even at higher pressures.

Example 5: Inflator Analysis

A composition representative of Example 1 was prepared and it included 65.4% basic copper nitrate, 34.4% melamine nitrate, and 0.2% polyethylene, by weight. Its inflator performance was compared to the compositions of comparative Examples 3 and 4. Thus, the main difference between the representative of Example 1 and comparative Examples 3 and 4 is the main fuel. The percentages of the ingredients varied slightly in order to maintain oxygen balance at 0%. The inflator performance for comparative Examples 3 and 4, which used melamine and cyanuric acid as the main fuel respectively, were unattainable because they would not sustain combustion in the inflator. The use of melamine nitrate worked well, even given the low combustion pressures of the test. See FIG. 1. So the composition with melamine nitrate was the only composition that resulted in satisfactory inflator performance.

The most direct comparison is between the 54.3 $mm^2$ flow area out of the inflator. The short dash and dotted curves that fall flat below 20 kPa in tank pressure indicate that the combustion was not sustainable and the gases more or less leak out of the inflator with no significant force. Propellant was left over unburned inside the inflator.

The curves with initial spikes relate to internal inflator combustion pressure (as shown on the primary y axis). Typically inflators, at −40° C. as are the current test, would be around 30 MPa. Thus the representative example will allow very low chamber pressures (inside the inflator) while reaching acceptable pressures in the ballistic testing tank (secondary y axis), making them suitable for use in airbag systems.

Figure 4:
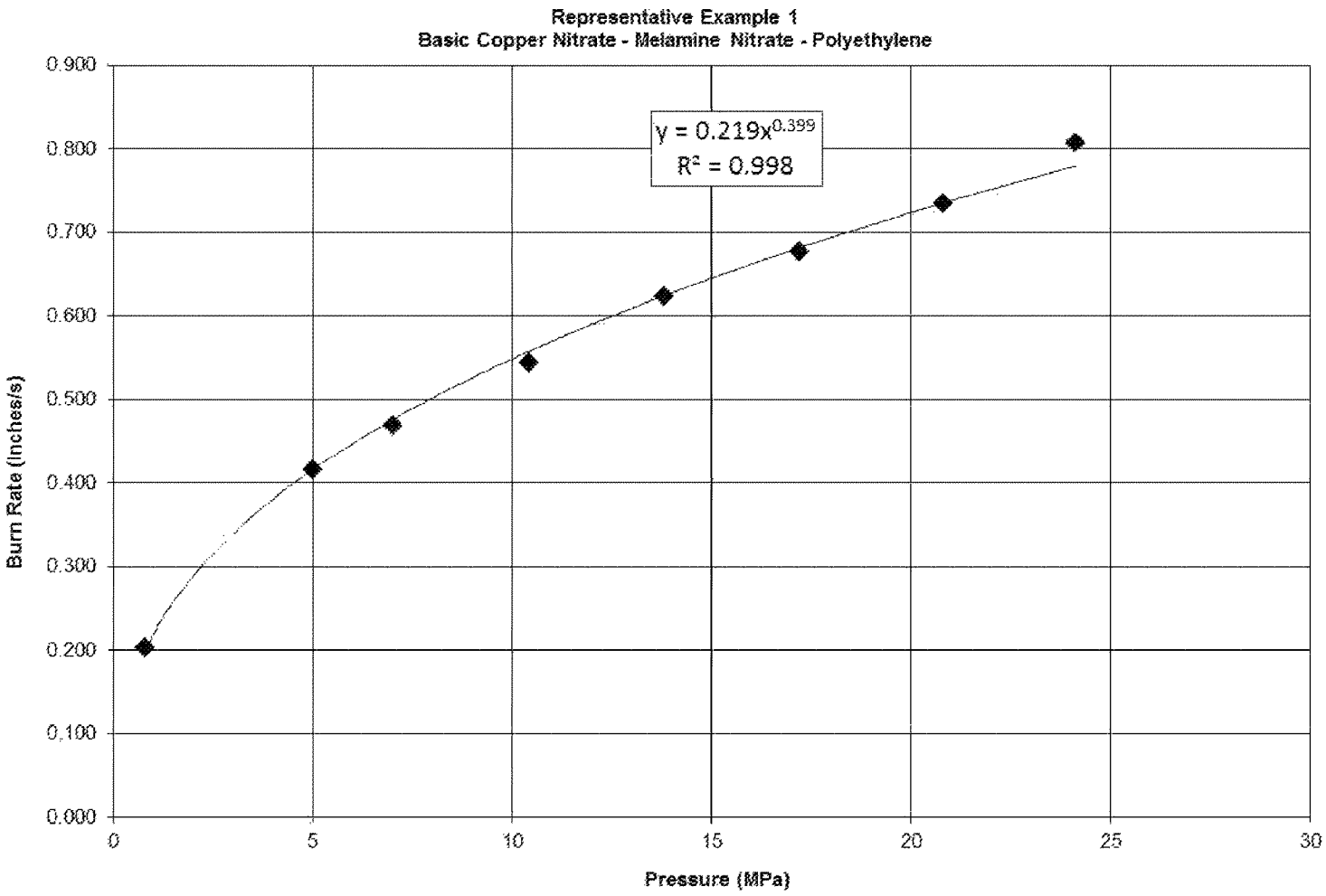
FIG. 4 is a graph of the burn rate (in inches per second) at various pressures of the generating compositions representative of Example 1.

The composition representative of Example 1 was also tested for burn rate at various pressures. The results are shown in FIG. 4. The pressure exponent n is 0.399, with a 0.998 $R^2$ value over pressures ranging from 1 to 20 MPa. The data further support the inflator performance comparison as shown in FIG. 1. Again, comparative Examples 3 and 4 would not even ignite during burn rate testing, even at higher pressures.

The materials and methods of the appended claims are not limited in scope by the specific materials and methods described herein, which are intended as illustrations of a few aspects of the claims and any materials and methods that are functionally equivalent are within the scope of this disclosure. Various modifications of the materials and methods in addition to those shown and described herein are intended to fall within the scope of the appended claims. Further, while only certain representative materials, methods, and aspects of these materials and methods are specifically described, other materials and methods and combinations of various features of the materials and methods are intended to fall within the scope of the appended claims, even if not specifically recited. Thus a combination of steps, elements, components, or constituents can be explicitly mentioned herein; however, all other combinations of steps, elements, components, and constituents are included, even though not explicitly stated.

What is claimed is:

1. A gas generating composition, comprising:
from 45 to 55% by weight of a metal nitrate;
from 25 to 30% by weight of melamine nitrate; and
from 5 to 15% by weight of a nitrogen containing organic compound chosen from guanidine, nitroguanidine, guanidine nitrate, aminoguanidine, aminoguanidine nitrate, and aminoguanidine hydrogen carbonate.

2. The composition of claim 1, wherein the metal nitrate is chosen from basic copper nitrate, a basic cobalt nitrate, a basic zinc nitrate, a basic manganese nitrate, a basic iron nitrate, a basic molybdenum nitrate, a basic bismuth nitrate, and a basic cerium nitrate.

3. The composition of claim 1, wherein the metal nitrate is basic copper nitrate.

4. The composition of claim 1, wherein the nitrogen containing organic compound is guanidine nitrate.

5. The composition of claim 1, further comprising from 1 to 10% by weight of an alkali metal salt of perchloric acid or an alkaline earth metal salt of perchloric acid.

6. The composition of claim 5, wherein the salt of perchloric acid is potassium perchlorate.

7. The composition of claim 1, further comprising from 1 to 10% by weight of a carbonate.

8. The composition of claim 7, wherein the carbonate is chosen from ammonium carbonate, calcium carbonate, basic copper carbonate, magnesium carbonate, and combinations thereof.

9. The composition of claim 7, wherein the carbonate is basic copper carbonate or basic bismuth carbonate.

10. The composition of claim 1, wherein the melamine nitrate has a particle size of less than 10 μm.

11. The composition of claim 1, further comprising an additive for lubrication during pressing operation.

12. The composition of claim 11, wherein the additive is polyethylene in an amount of from 0.1 to 0.5% by weight.

13. The composition of claim 1, further comprising from 1 to 3% fumed silica, fumed alumina, aluminum hydroxide, aluminum titanate, magnesium aluminate, or any combination thereof.

14. The composition of claim 1, wherein the composition, comprises:

from 45 to 55% by weight of basic copper nitrate;

from 25 to 30% by weight of melamine nitrate;

from 5 to 15% by weight of guanidine nitrate;

from 5 to 7% by weight of basic copper carbonate or basic bismuth carbonate;

from 1 to 5% by weight of potassium perchlorate;

from 1 to 3% by weight fumed silica, fumed alumina, aluminum hydroxide, aluminum titanate, magnesium aluminate, or any combination thereof; and from 0.1 to 0.3% by weight polyethylene.

15. A molded article, comprising the composition of claim 1.

16. A method of forming a molded article, comprising:

combining from 45 to 55% by weight of a metal nitrate; from 25 to 30% by weight of melamine nitrate; from 5 to 15% by weight of a nitrogen containing organic compound chosen from guanidine, nitroguanidine, guanidine nitrate, aminoguanidine, aminoguanidine nitrate, and aminoguanidine hydrogen carbonate, from 1 to 10% by weight of a secondary oxidizer chosen from an alkali metal or alkaline earth metal salts of perchloric acid and carbonate, and optionally from 1 to 3% by weight of fumed silica, fumed alumina, aluminum hydroxide, aluminum titanate, magnesium aluminate, or any combination thereof; and optionally from 0.1 to 0.3% by weight polyethylene to form a blend;

granulating the blend; and pressing the blend into a molded article.

17. The method of claim 16, further comprising jet milling the melamine nitrate before combining it with the metal nitrate and nitrogen containing organic compound.

18. Method of inflating an air bag, comprising: igniting a gas generating composition of claim 1, in a gas generator, wherein the gas generator has an internal pressure of less than 20 MPa.

19. The method of claim 18, wherein the internal pressure is less than 15 MPa.

* * * * *